US005141140A

United States Patent [19]

Moffett-Hall

[11] Patent Number: 5,141,140

[45] Date of Patent: Aug. 25, 1992

[54] APPARATUS FOR THE CREATION OF FABRIC APPLIQUES AND METHOD OF USING SAME

[76] Inventor: Deborah J. Moffett-Hall, 2815 Elroy Rd., Hatfield, Pa. 19440

[21] Appl. No.: 682,670

[22] Filed: Apr. 9, 1991

[51] Int. Cl.[5] ..... D06C 15/00; D06C 3/08

[52] U.S. Cl. ..... 223/52; 223/44; 223/52.5; 223/52.6; 223/1; 38/102.2; 38/142.3

[58] Field of Search ..... 223/1, 52, 44, 52.5, 223/52.6, 57, 100, 38; 112/119, 103, 121.12, 121.15; 38/102.2, 102.3; 425/318

[56] References Cited

U.S. PATENT DOCUMENTS

| | | | |
|---|---|---|---|
| 327,961 | 10/1885 | Moschcowitz . | |
| 1,912,931 | 6/1933 | Clay . | |
| 1,951,246 | 3/1934 | Kirkpatrick | 38/102.2 |
| 2,131,390 | 9/1938 | Rosenfeld . | |
| 2,324,009 | 7/1943 | McDonough | 223/1 |
| 2,371,318 | 3/1945 | Rosenfeld . | |
| 2,515,450 | 7/1950 | Hull . | |
| 2,661,878 | 12/1953 | Janssens | 223/100 |
| 2,666,935 | 1/1954 | Gilbert et al. | 223/38 X |
| 2,751,963 | 6/1956 | Valentine . | |
| 2,892,196 | 6/1959 | Pundyk et al. . | |
| 3,226,732 | 1/1966 | Zerilli . | |
| 3,270,696 | 9/1966 | Lowenstein . | |
| 3,325,826 | 6/1967 | Ryan . | |
| 3,373,236 | 3/1968 | Taplin . | |
| 3,406,407 | 10/1968 | Parlanti . | |
| 3,415,428 | 12/1968 | Mishkin | 223/1 |
| 3,527,858 | 9/1970 | Braxton et al. . | |
| 3,885,333 | 5/1975 | Zachary | 38/102.2 |
| 3,898,943 | 8/1975 | Braden et al. . | |
| 4,395,964 | 8/1983 | Warren . | |
| 4,445,631 | 5/1984 | del Castillo-Olivares | 223/1 |
| 4,485,574 | 12/1984 | Bennetot | 112/103 X |
| 4,590,695 | 5/1986 | McGillivray | 38/102.2 |
| 4,677,775 | 7/1987 | Riley | 38/102.2 |
| 4,723,367 | 2/1988 | Samoilov et al. | 38/102.2 |
| 4,762,076 | 8/1988 | Wakaizumi | 112/103 |
| 4,867,085 | 9/1989 | Brace et al. . | |

OTHER PUBLICATIONS

"Applique Basics," *Better Homes and Gardens Applique*, pp. 6-9 (1978).

"Teach Yourself To Quilt—Step-By-Step Instructions", Leisure Arts Craft Leaflets, Leaflet No. 1179, pp. 8-10, 12-14 (1988).

"Needlework Nostalgia," Ed. by Barbara Weiland, Butterick Publishing pp. 85-87 (1975).

Kimball, J., "Red and Green—An Applique Traditional," That Patchwork Place, pp. 151-156 (1990).

"Which Applique Technique Shall I Use?," *Quilter's Newsletter Magazine*, pp. 38-39 (Jun. 1989).

"General Directions," *Quilting Today*, pp. 16, 25-26 (Fall 1989).

Hartman, M., "Christmas Heart Tree," *Quilt World*, p. 56 (Christmas 1990).

*Primary Examiner*—Werner H. Schroeder
*Assistant Examiner*—Bibhu Mohanty
*Attorney, Agent, or Firm*—Ferrill, Logan, Johns & Blasko

[57] ABSTRACT

The present invention provides apparatus and method for the creation of appliques for quilting. Employing a shape plate with an opening in the desired shape of the applique and a corresponding template adapted to be inserted into the opening, quilting material can be easily flattened through ironing or similar methods into uniform and readily applied appliques. The present invention permits the efficient and safe production of even intricate appliques and lends itself to many improvements.

20 Claims, 4 Drawing Sheets

APPARATUS FOR THE CREATION OF FABRIC APPLIQUES AND METHOD OF USING SAME

BACKGROUND OF THE INVENTION

1. Field of the Invention

The present invention is directed to a apparatus and method for use in decorative fabric quilt production. Specifically, the invention is directed to an apparatus and method for preparation of appliques for use in quilt item production.

2. Description of the Prior Art

One common form of quilt production calls for the creation of appliques to be applied to a quilted item. An applique is a piece of fabric cut in a desired shape and then sewn onto a background fabric. By repeating appliques or combining them with different shaped appliques, the artisan creates specific scenes, objects or pictures and/or geometric patterns or designs.

In order to avoid fraying and to create a clean edge, it is required that the cut edge of each applique be finished or sewn under the applique during its attachment. In this regard, numerous techniques have been developed.

In hand sewn appliques, it is most common for the seam to be finished by any of the following methods: covering the raw edges with stitches; needle turn of the edges; English paper piecing; reverse applique; freezer paper methods: or template, starch or glue method. In machine-sewn appliques, the seams are most commonly finished by: the raw edges being covered with satin or decorative stitches; or the edges being turned under, stitching with a hem stitch, straight stitch, or decorative stitch.

Although the finishing of the raw edges of the appliques with overcast stitches is the simplest technique, it does not create the most professional appearance possible.

In needle turn appliques, a pattern is used to trace a shape onto the applique fabric and the shape is cut out including a small (e.g. 3/16") seam allowance. The same shape is then traced onto a background fabric to be used as a guide for placement and stitching. The applique is held in place over the guideline and the two fabrics with outlines are aligned by turning under the seam allowance with the needle as the applique is sewn into place. This procedure is known to be quite time consuming and as requiring a substantial amount of skill in order to create a professional product.

In paper piecing technique, numerous templates are cut out to the exact shape of the desired appliques. One paper piece template is needed for each and every element to be appliqued (e.g. if a flower has four petals and there is to be four flowers, sixteen petals must be cut from paper). The applique fabric is then cut out of slightly larger fabric to provide a 3/16 to ¼" seam allowance. Using the paper templates, the seam allowance is folded over the edges of the template and basted directly to the paper so that the paper is encased by the fabric on all sides. Once the prepared shape is completely stitched to the background fabric, the background fabric is then cut away from the back of the applique and the paper is torn away. Again this is a time consuming and tedious process. Moreover, this procedure requires the cutting of the background fabric, with its inherent weakening of the final quilt.

In the reverse applique technique, the desired shape is traced onto the background fabric. A contrasting fabric is placed underneath and secured in place. The shape is then cut out leaving 3/16" inside seam allowance. The background fabric is turned under to the marked line and stitched to the contrasting fabric that was placed underneath. Again, this technique requires substantial skill and patience to accomplish effectively.

The freezer paper method employs templates cut from freezer paper which includes a thin layer of plastic. The plastic reacts to heat from an iron and will temporarily adhere to fabric. The plastic coated side of the paper is placed face up on the applique fabric and the cut edges of the applique are folded up and over the paper template. The edges of the applique are then caused to adhere to the coating by application of an iron. This method has a number of drawbacks, including that it requires tedious cutting of templates, that fingers are easily burned with the delicate ironing work required, and that the background fabric must be cut to remove the template after attachment.

The template and starch/glue method employs a reusable template of plastic or heavy paper cut to the exact size and shape of the desired applique. The fabric is cut with a 3/16" or ¼" seam allowance surrounding the desired shape and the template is centered on the back side of the fabric. In the glue method, a fabric adhesive is applied around the perimeter of the shape and the seam allowance is folded over the template and adhered with the glue. The glued applique is then stitched to the background fabric and the template is removed when the background fabric is cut away from the back of the quilt. Although this method is far easier than some of the previously discussed methods, it still believed to be too time consuming. Moreover, this method often results in stained or discolored fabrics and still requires the undesirable cutting of the background material.

The same basic method is used in the starch method, only fabric starch and a hot iron are used to fold the seam allowance over the template. Starch is sprayed or daubed onto the fabric and the seam allowance is manually folded over the template and hot ironed into place. Although still requiring considerable time and manual dexterity to successfully iron the fabric around the template and to avoid injury from the hot iron, here the template can be removed prior to sewing if the starch and iron succeeded in creating a defined edge—thus avoiding the need to cut the background fabric. Alternatively, the template can be kept in place and removed by cutting the background fabric. Again, this method is believed to be less than fully acceptable.

It is therefore the primary object of the present invention to provide apparatus and method for preparing appliques in a quick, easy, safe and uniform manner.

It is an additional object of the present invention to provide such an apparatus and method which requires minimal skill or manual dexterity, even for the creation of relatively complex appliques.

It is a further object of the present invention to provide such an apparatus and method which permits appliques to be easily attached to a quilt without the need for cutting or otherwise altering or weakening the quilt or its background fabric.

It is another object of the present invention to provide the benefits of the starch and ironing process while making that process easier, safer and quicker.

It is yet another object of the present invention to provide such an apparatus and method which shortens preparation time and effort by avoiding the need for tracing the applique shape onto the fabric.

These and other objects of the present invention will become evident from review of the following specification.

SUMMARY OF THE INVENTION

The present invention provides an apparatus and method for preparation of quilt appliques. The invention in its simplest form provides a shape plate with an opening in the shape of the desired applique, and a template having the same shape and a slightly smaller size as the opening. Quilting material or fabric is first cut out approximating the final shape while allowing a seam allowance around its border and then centered over the opening in the shape plate. By inserting the template through the fabric and into the opening, the shape of the applique is creased into the fabric. With the template fully inserted into the shape plate and the seam allowance left exposed in an upright position, an iron or similar device may then be employed to flatten the material into a final applique without the user's fingers needed to guide seam allowance into position thus avoiding potential harm from a hot iron. The completed appliques are finished, uniform and can be removed from the template and applied to the quilted item without the burdensome cutting and folding or basting (sewing) previously required.

Among the improvements disclosed on the basic apparatus and process of the present invention are providing a base plate for more secure and accurate insertion of the template, providing a lifter member to accommodate a variety of material thicknesses, and providing means to lock the template into the shape plate for ease in flattening the seam allowance.

The present invention offers distinct improvements over prior methods of creating appliques. The present invention is far faster, safer and easier than existing methods, virtually eliminating the manual dexterity now required or the potential risks from hot irons. Moreover, the apparatus of the present invention permits the creation of appliques far more intricate and with greater consistency of form than now possible for most artisans. Finally, the present invention eliminates the common problem of small irregularities along curved edges due to the difficulty of ironing along a curve.

DESCRIPTION OF THE DRAWINGS

The operation of the present invention should become apparent from the following description when considered in conjunction with the accompanying drawings, in which.

DETAILED DESCRIPTION OF THE INVENTION

The present invention provides improved apparatus and method for preparation of appliques for quilting.

Figure 1:
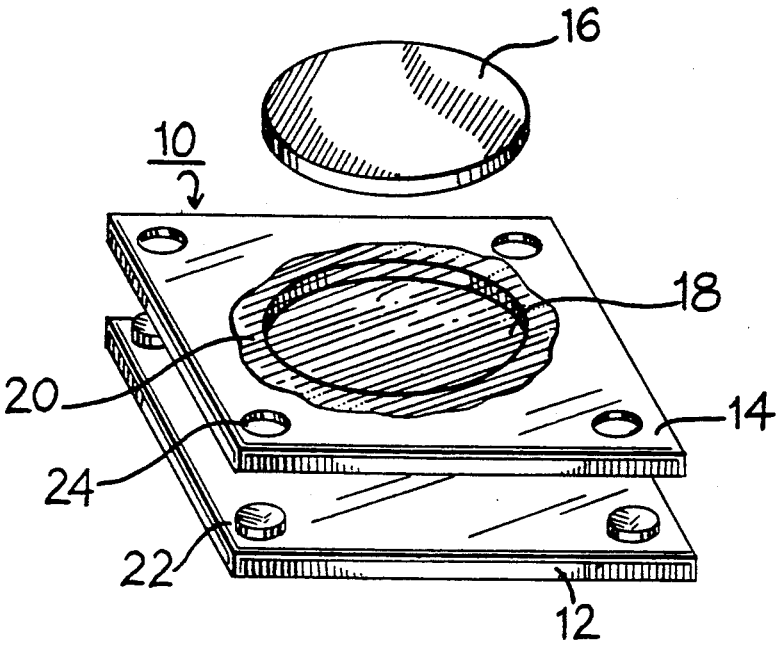
FIG. 1 is an exploded three-quarter elevational view of apparatus of the present invention.

Shown in FIG. 1 is one embodiment of apparatus 10 for use with the present invention. The apparatus 10 comprises a base plate 12, a shape plate 14, and a template 16. The shape plate 14 is provided with one or more openings 18 in a desired shape or shapes for the appliques. Although a circular shape is shown for the opening 18 in FIG. 1, it should be appreciated that the present invention may be employed to create a wide variety of applique shapes and that the present invention is not intended to be limited to any particular shape or shapes. In fact, as should be evident from the following description, the present invention permits the creation of far more complex and intricate quilting appliques than were previously deemed practical for most artisans.

The template 16 is formed in the same shape as the opening 18 in the shape plate 14 and a slightly smaller size to permit insertion of the template 16 and quilting material 20 into the opening 18. As is known, quilting material 20 may comprise a wide variety of fabrics, including cotton, synthetic blends, silk, natural/synthetic blends, linen, or any combination of fibers. These fabrics may comprise a wide variety of thicknesses. For most applications, an allowance of 0.003 to 0.012" between the template 16 and the shape plate 14 is sufficient to accommodate most quilting fabrics. However, for thicker fabrics, various sizes of templates may be provided to allow for creation of appliques from virtually any thickness of fabric.

Although not required, a base plate 12 may be employed with the shape plate 14 to provide a stop for the insertion of the template 16 to the correct position Alternatively, a shape plate 14 may be employed alone, utilizing a table or other work surface as a stop. For ease in operation when the base plate is used, the base plate 12 and the shape plate 14 may be attached to each other using a variety of means, including permanently gluing or welding the two plates together. In the preferred embodiment, the two plates are provided with means to connect the plates together while permitting them to be separated whenever it is required. This allows any number of different shape plates 14 to be attached to the base plate 12. The connecting means in the embodiment shown comprises a one or more male connectors 22 in the base plate 12 and one or more corresponding female receivers 24 in the shape plate 14.

Figure 2:
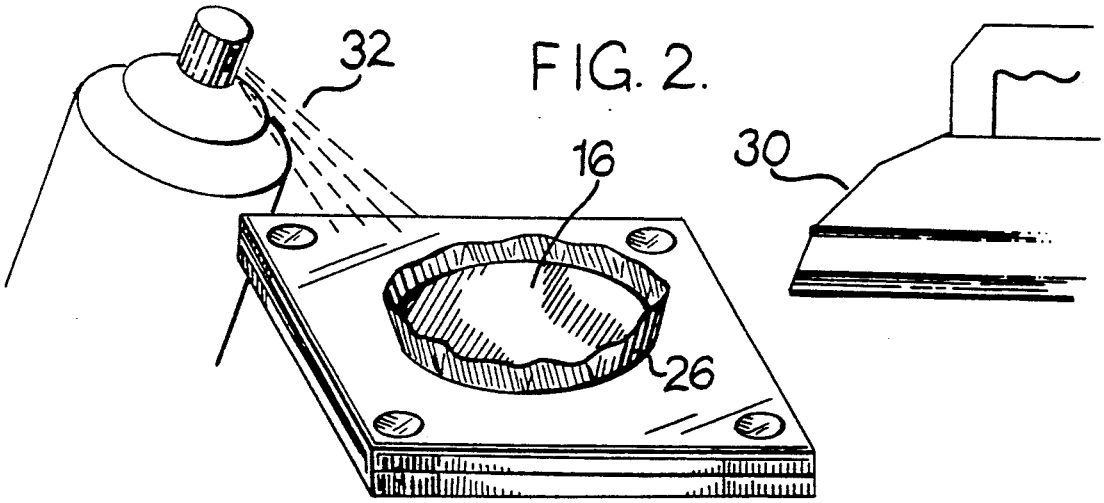
FIG. 2 is a three-quarter elevational view of the apparatus of the present invention with a piece of applique fabric inserted therein.
Figure 3:
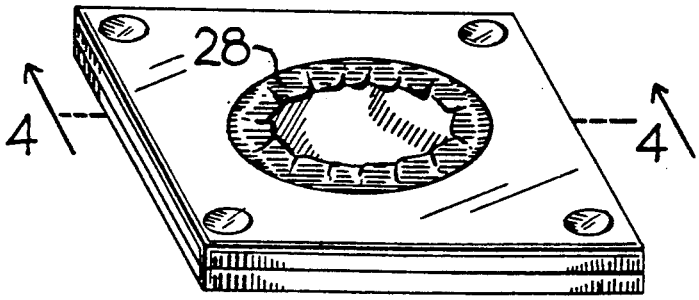
FIG. 3 is a three-quarter elevational view of the apparatus of the present invention with a completed applique inserted therein.

The operation of the present invention is shown in FIGS. 1 through 3. Prior to use, the quilting material 20 is cut out in approximately the correct shape, providing a seam allowance of 3/8 to ¼". To ease this procedure, the template 16 may be positioned over the material 20 and the shape may be traced onto the material to provide a pattern for cutting. The material 20 is then centered over the opening 18 in shape plate 14.

Once the material 20 is positioned, the template 16 is inserted into the opening 18. Due to the snug fit between the template 16 and the shape plate 14, the insertion of the template 16 will cause the material's seam allowance 26 to stand up in a manner similar to that shown in FIG. 2. In order to ease insertion and/or flattening of the seam allowance 26, it is preferred that small cuts be made around any curved edges of the material 20 before or after it is inserted into the shape plate 14. This allows the material 20 to be inserted and flattened smoothly, with limited binding or bunching. If the cuts are made after insertion in the base plate 12, assuring that the cuts are properly centered and do not extend into the exposed surface of the applique.

At this stage, the seam allowance 26 may be easily flattened into a finished applique 28 as shown in FIG. 3. The finished applique 28 may then be removed from the shape plate 14, the template 16 removed therefrom, and then sewn into place on a quilt in a conventional manner. If necessary, the shape plate 14 may be separated from the base plate 12 to allow the template 16 and the applique 28 to be pushed out of the shape plate 14. After removal of the template 16, the applique may need to be ironed to reestablish its shape; however, this is easily accomplished since the shape is clearly defined through the above process and generally it can be done with one pass of an iron. Moreover, without departing from the present invention, for some applications the template 16 may be kept within the applique and removed after it is sewn in place in the manner employed in the prior art.

As is shown in FIG. 2, to aid in the flattening of the fabric material 20, a conventional iron 30 or similar device may be employed to iron the seam allowance 26 down around the template 16. To accommodate this procedure, the template 16 and shape plate 14 should be constructed from material that will withstand contact with an iron. To this end, any material that will withstand at least 200°-500° F. without melting or distorting, such as sheet metal, acrylic plastic, nylon, glass, various polymers, wood, or ceramics, may be used. For most cotton fabrics, a temperature of 200° F. is sufficient. After ironing, the fabric should be allowed to cool for about 30 seconds before removal.

To assist further in flattening the material 20, it is preferred that a starch 32 or similar composition be applied to the material 20 prior to ironing to help maintain the flattened shape. This composition may include without limitation: spray starch, spray sizing, liquid starch, water & sugar, fabric stiffener, or similar products.

Figure 4:
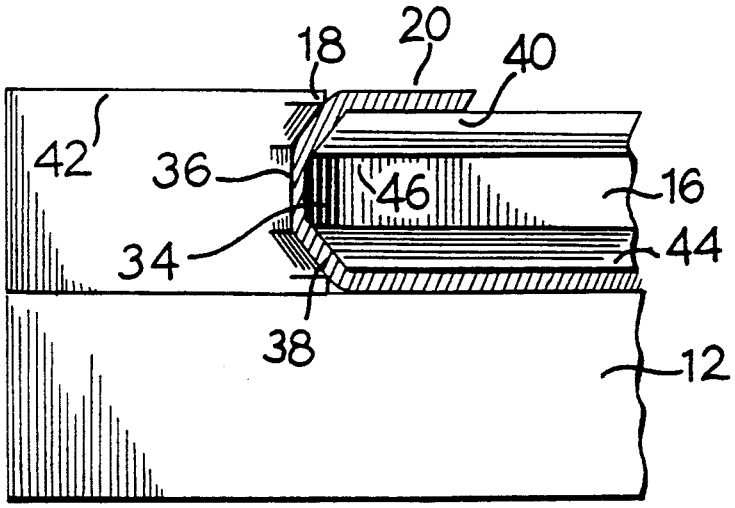
FIG. 4 is an enlarged cross-sectional view of the apparatus of the present invention along line 4—4 of FIG. 3.

It is desirable to provide means to lock the template 16 and the quilting material 20 into the shape plate 14 to ease in the ironing process. Shown in FIG. 4 is one such means to accomplish folding of the quilting material and locking of the quilting material within the shape plate. As is shown, the template 16 is provided with a protruding edge 34 along part or all of its periphery, and the shape plate 14 is provided with a corresponding groove 36 along part or all of the periphery of opening 18. As has been discussed, enough of a gap 38 should be left between the template 16 and the shape plate 14 to leave space for the insertion of the quilting material 20. An elastomer lip 46, such as a band of rubber or other plastic, may be provided on the edge to aid in securing the template 16 within the shape plate 14 and to make the insertion and removal of the template 16 easier.

Slight flexibility of the template 16 and the shape plate 14 permit the template 16 and fabric 20 to be relatively easily "snapped" into the shape plate 14. For removal, if enough flexibility is provided in the shape plate 14 and base plate 12, the two plates 12, 14 may be flexed to cause the template 16 and applique 28 to be "popped" out. If the applique cannot be removed in this manner, the two plates 12, 14 may be separated in the manner discussed above, and the template 16 and applique 28 may be pushed out from underneath. Additionally, a small hole (not shown) may be provided through the base plate 12, corresponding to the inserted position of the template 16, to permit the template 16 to be pushed out while the base plate 12 and the shape plate 14 remain attached to each other.

In order to create an applique 28 as flat as possible, it is desirable that the plane of the template's top surface 40 be close to level to the plane of the shape plate's top surface 42 less the width of the fabric. Accordingly, the template 16 should be constructed to be slightly narrower than the shape plate 14 to accommodate the insertion of quilting material 20 between the template's bottom surface 44 and the base plate 12 and to allow for overlap on surface of template.

Other suitable means for locking the template 16 and fabric 20 into the shape plate 14 may include a spring loaded catch within the template or shape plate, a magnetized template and/or base plate, or a spring clip or similar device to hold the template in place. Some of these other embodiments of the present invention are discussed in greater detail below.

Figure 5:
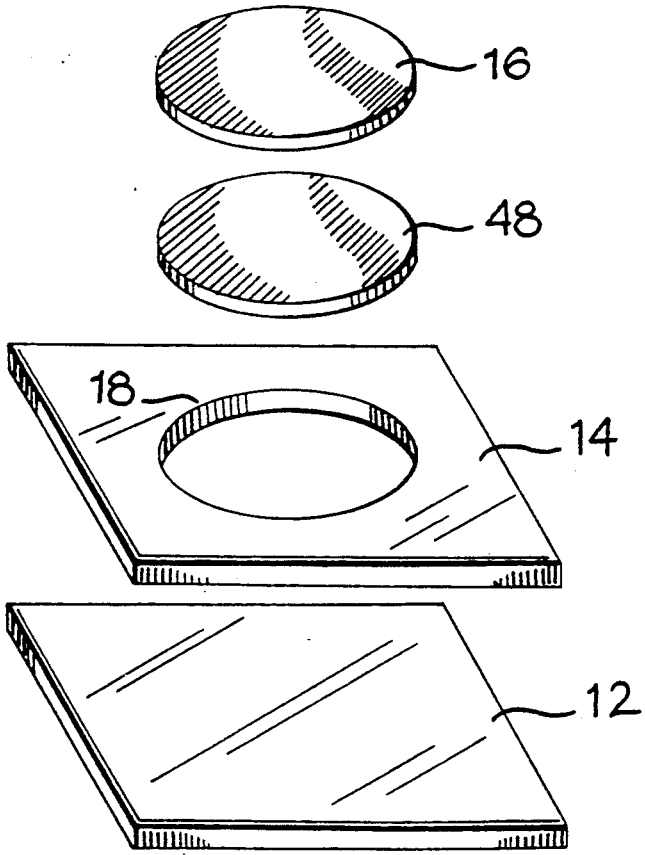
FIG. 5 is an exploded three-quarter elevational view of another embodiment of the apparatus of the present invention.
Figure 6:
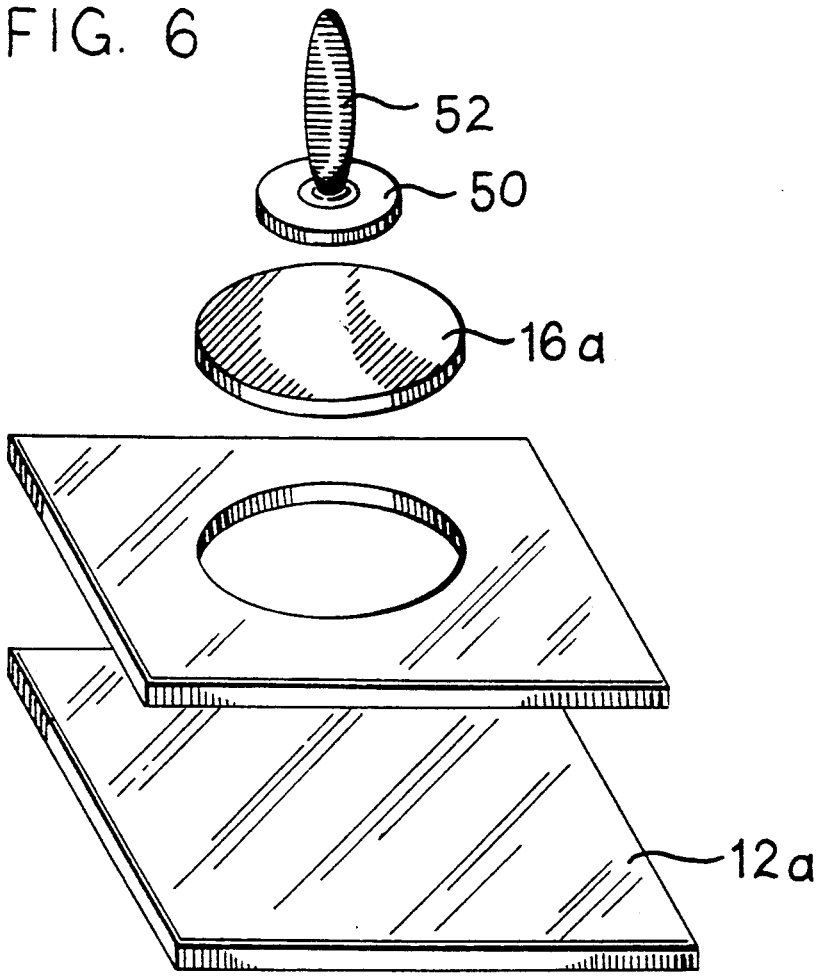
FIG. 6 is an exploded three-quarter elevational view of the apparatus of the present invention showing another embodiment of means to lock the template into position.

Although different templates 16 and/or shape plates 14 can be employed to accommodate wide extremes in thicknesses of material 20, it is also possible to provide for different thicknesses of quilting materials 20 by providing one or more lifter members 48 of various thicknesses. As is shown in FIG. 5, a lifter member 48 is inserted into the opening 18 prior to the quilting material 20 and the template 16 to support the template 16 at the correct height for ironing. For thin quilting materials, a relatively thick lifter member 48 is employed to raise the template's top surface to nearly even with the shape plate's top surface; for materials of greater thicknesses, thinner (or no) lifter member can be used.

Examples of other means to lock the template into the shape plate are shown in FIGS. 6 through 9. It should be understood that these embodiments represent only a sampling of the variety of possible means to lock the template and quilting material into position. In the embodiment shown in FIG. 6, a ferro-metallic template **16*a* and a ferro-metallic base plate 12*a* are employed. By using a magnet 50 attached to the top of the metal template 16*a*, the entire unit can be kept locked into place. The magnet 50 should be small enough to permit the seam allowance to be ironed over the template without overlapping the magnet 50, but strong enough to secure the template 16*a* and quilting material to the base plate 12*a*. A handle 52 may be provided on the magnet 50** to ease its placement, adjustment and removal.

Figure 7:
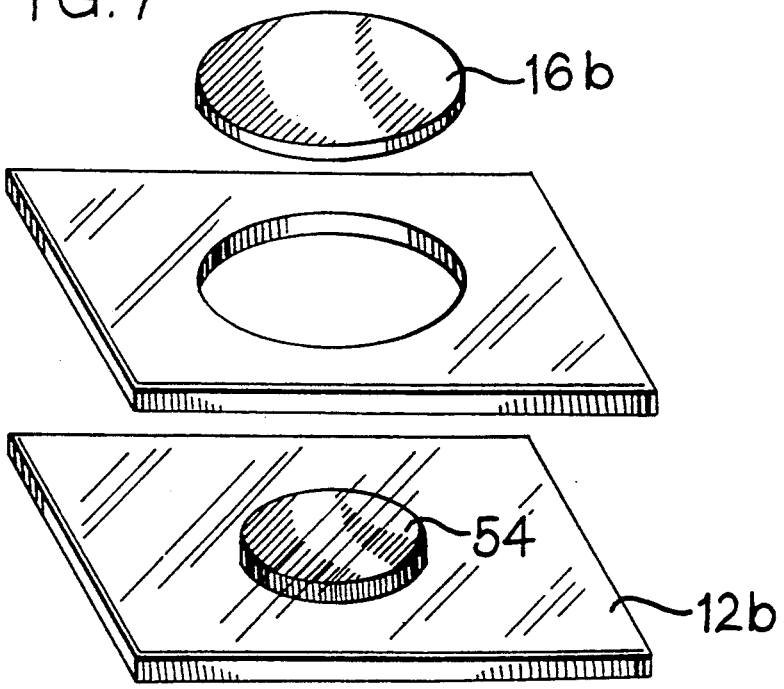
FIG. 7 is an exploded three-quarter elevational view of the apparatus of the present invention showing still another embodiment of means to lock the template into position.

A similar concept is shown in FIG. 7. A metal template **16*b* is again employed and a magnet 54 is provided within base plate 12*b*** to hold the template in place.

Alternatively, a metal base plate may be employed and the template itself may be constructed from magnetic material. In either form, it may be desirable to provide a handle on the template to ease in its placement and removal.

Figure 8:
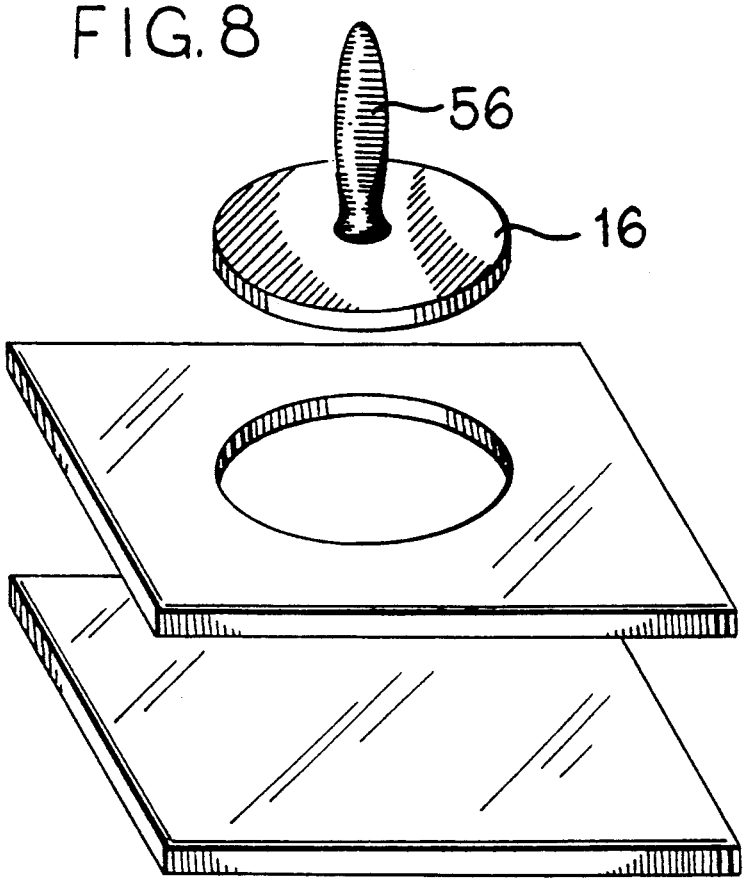
FIG. 8 is an exploded three-quarter elevational view of the apparatus of the present invention showing yet another embodiment of means to lock the template into position.

In the embodiment shown in FIG. 8, a template handle 56 is provided on template 16*c*. A user then supplies the pressure needed to hold the template and fabric secure within the shape plate opening by pressing down on the template handle 56 while the fabric is in place and then ironing with the other hand. This helps keep the template in position while allowing the user to keep his or her hands away from the hot iron. Each template can then be provided with its own handle 56, or the handle 56 may be detachable to permit use with multiple templates.

Figure 9:
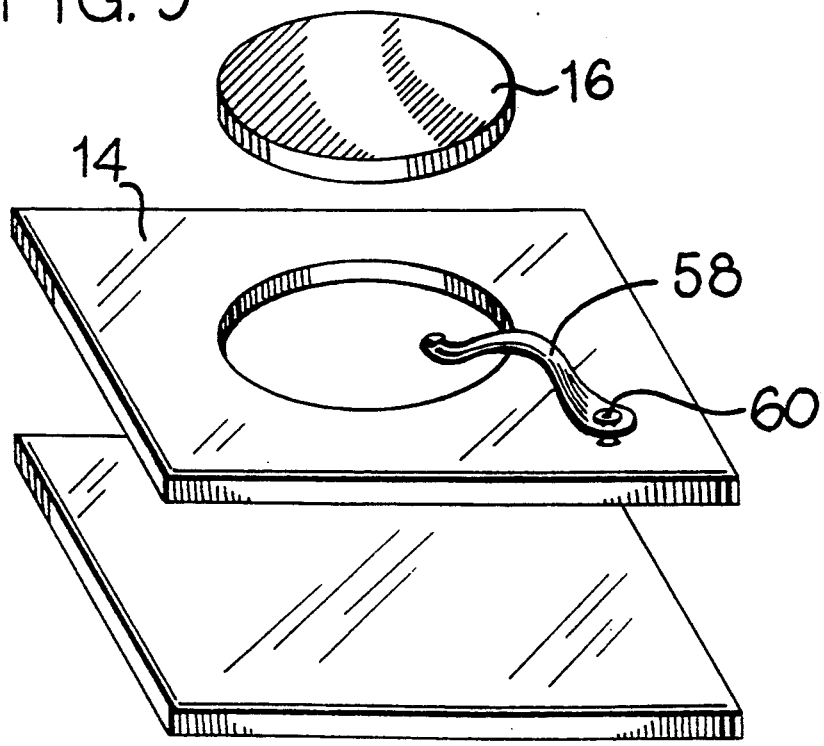
FIG. 9 is an exploded three-quarter elevational view of the apparatus of the present invention showing a further embodiment of means to lock the template into position.

In the embodiment shown in FIG. 9, a spring or tension clip 58 is provided on the shape plate 14. The template 16 and fabric may then be inserted in place and the clip 58 used to hold the template 16 in position during ironing. A swivel 60 can be provided on the clip 58 so that it may be moved out of position to ease placement and removal of the template 16 and quilting material. The clip 58 should provide enough pressure to hold all elements firmly in place while the user applies an iron. It is preferred that the clip arch upward high enough to allow the user to slip the tip of the iron under the clip to permit ironing of the complete circumference of the applique.

The present invention also lends itself to other modifications which simplify the process of quilting. For instance, in addition to using the template as a guide for tracing the shape of the applique onto the quilting material 20 prior to cutting, the shape may also be imposed onto the material by inserting the template 16 and material partially or entirely into the shape plate 14 to act as a guide for cutting.

Further, as has been noted, the present invention may be used to create any number of applique patterns. To this end, more than one pattern may be provided on the shape plate 14 to increase its utility. Additionally, it is often desirable to invert the shape plate 14 to permit the creation of opposite asymmetric designs; to accommodate this, means may be provided on both sides of the shape plate 14 to permit its attachment to the base plate in either direction.

The present invention provides distinct improvements over prior methods of creating appliques. The present invention provides far greater safety from burned and pricked fingers, while greatly decreasing the time and effort of creating the many repetitive shapes required for applique quilting. Moreover, the ease of the present invention allows an artisan to create a vast number of shapes and designs which were far too complex and/or time consuming using conventional methods.

Although particular embodiments of the present invention are disclosed herein, it is not intended to limit the invention to such a disclosure and changes and modifications may be incorporated and embodied within the scope of the following claims.

I claim:

1. An apparatus for preparing a quilt applique comprising:

a plate for receiving quilting material, said plate containing an opening in a shape desired for said applique;

a template having a periphery substantially identical in shape to said opening;

wherein quilting material is placed between the template and the opening in the plate, leaving an edge of quilting material exposed around the periphery of the template;

said plate and template having folding means to force the edge of the quilting material above said plate so it folds inward around the entire periphery of the template; and wherein the interaction of the plate and the template permit the edge to be pressed against the template to form an applique with an outside dimension the same as the template.

2. The apparatus of claim 1 wherein said template and said plate are constructed of a substance capable of withstanding ironing.

3. The apparatus of claim 2 wherein said substance possesses a heat tolerance of at least 200 degrees Fahrenheit.

4. The apparatus of claim 1 wherein said quilting material is secured between said plate and said template by locking means.

5. The apparatus of claim 4 wherein said locking means comprises a groove formed within said opening in said plate, and an edge on said template;

wherein locking is achieved between said plate and said template by engaging said groove with a second edge on said template.

6. The apparatus of claim 1 providing lifter means for utilizing quilting materials of varying thickness.

7. The apparatus of claim 6 wherein said lifter means for utilizing varying quilting materials comprises providing at least one lifter member for insertion in said opening, said lifter member adjusting the level of said quilting material to a level for ironing into the desired shape.

8. An apparatus for preparing quilt appliques comprising:

a base plate;

a shape plate for receiving a quilting applique material, said shape plate containing an opening;

connecting means for said base plate and said shape plate;

a template substantially identical in shape to said opening in said shape plate, permitting insertion of said quilting material between said template and said shape plate opening and said shape plate and template having folding means such that an inward fold is created towards the central area of the opening on said quilting material to form an applique in the same shape and dimensions as the opening of the shape plate; and means for securing said quilting material between said template and said opening in said shape plate.

9. The apparatus of claim 8 wherein said connecting means is integral with said shape plate and said base plate.

10. The apparatus of claim 9 wherein said integral connecting means comprises a male connector on one of said plates and a female receiver on the other of said plates.

11. The apparatus of claim 8 wherein said template and said plate are constructed of a substance capable of withstanding ironing.

12. The apparatus of claim 11 wherein said substance possesses a heat tolerance of at least 200 degrees Fahrenheit.

13. The apparatus of claim 8 wherein said folding means comprises a groove inscribed within said opening in said shape plate and an edge on said template, wherein the shape plate and the template are secured together by engaging a second template groove with said edge.

14. The apparatus of claim 8 providing lifter means for utilizing quilting materials of varying thickness.

15. The apparatus of claim 14 wherein said lifter means for utilizing varying quilting materials comprises at least one lifter member for insertion in said opening, said lifter member adjusting the level of said quilting material to a level for ironing into the desired shape.

16. A method of preparing a quilting applique comprising:

providing a plate for receiving a quilting applique material with a select opening in a shape desired for said applique;

providing a corresponding template for insertion in said opening;

providing a quilting material for said applique, said material trimmed to the desired size while leaving a seam allowance along said material's edge;

centering said material over said opening in said receiving plate;

placing said template on top of said material;

shaping said material by applying pressure to said template, thereby inserting said material into said opening and causing said edges of said fabric to rise up above said template around the entire perimeter of the template;

finishing said applique by flattening the entire perimeter of said seam allowance inward over said template; and separating said applique from said receiving plate.

17. A method of preparing a quilting applique in accordance with claim 16 which includes pressing said seam allowance over said template, thereby flattening it.

18. A method of preparing a quilting applique in accordance with claim 17 which includes using an iron to flatten said seam allowance over said template.

19. A method of preparing a quilting applique in accordance with claim 16 which includes using said template to measure and trace the size of said material.

20. A method of preparing a quilting applique in accordance with claim 16 which includes using locking means for securing said material between said receiving plate and said template.

* * * * *